US006536284B2

(12) United States Patent
Bonanni

(10) Patent No.: US 6,536,284 B2
(45) Date of Patent: Mar. 25, 2003

(54) METHOD AND APPARATUS FOR COMPRESSOR CONTROL AND OPERATION VIA DETECTION OF STALL PRECURSORS USING FREQUENCY DEMODULATION OF ACOUSTIC SIGNATURES

(75) Inventor: Pierino Gianni Bonanni, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/878,314

(22) Filed: Jun. 12, 2001

(65) Prior Publication Data

US 2002/0184951 A1 Dec. 12, 2002

(51) Int. Cl.[7] ..... G01N 29/00; G06F 19/00

(52) U.S. Cl. ..... 73/660; 73/593; 73/602; 73/659; 702/56

(58) Field of Search ..... 73/659, 660, 593, 73/602; 702/56, 190

(56) References Cited

U.S. PATENT DOCUMENTS 4,429,578 A * 2/1984 Darrel et al. ..... 73/659
4,480,480 A * 11/1984 Scott et al. ..... 73/769
4,996,880 A * 3/1991 Leon et al. ..... 73/660
5,152,172 A * 10/1992 Leon et al. ..... 73/579
5,195,046 A * 3/1993 Gerardi et al. ..... 73/659
5,471,880 A * 12/1995 Lang et al. ..... 73/660
5,726,891 A 3/1998 Sisson et al. ..... 701/100
6,059,522 A 5/2000 Gertz et al. ..... 415/1
6,065,345 A * 5/2000 Holenstein et al. ..... 73/660
6,092,029 A 7/2000 Bently ..... 702/56
6,098,010 A 8/2000 Krener et al. ..... 701/100

* cited by examiner

*Primary Examiner*—Hezron Williams
*Assistant Examiner*—Jacques Saint-Surin
(74) *Attorney, Agent, or Firm*—Nixon & Vanderhye P.C.

(57) ABSTRACT

An apparatus for monitoring the health of a compressor comprising at least one sensor operatively coupled to the compressor for monitoring at least one compressor parameter, a calibration system coupled to the at least one sensor, the calibration system performing time-series analysis on the monitored parameter, a processor system for processing and computing stall precursors from the time-series analyzed data, a comparator that compares the stall precursors with predetermined baseline data, and a controller operatively coupled to the comparator which initiates corrective actions to prevent a compressor surge and stall if the stall precursors deviate from the baseline data which represents predetermined level of compressor operability. The processor system preferably includes a frequency demodulator and a system for processing the frequency demodulated signals to extract stall precursor characteristics.

35 Claims, 5 Drawing Sheets

METHOD AND APPARATUS FOR COMPRESSOR CONTROL AND OPERATION VIA DETECTION OF STALL PRECURSORS USING FREQUENCY DEMODULATION OF ACOUSTIC SIGNATURES

This invention relates to non-intrusive techniques for monitoring the rotating components of a machine. More particularly, the present invention relates to a method and apparatus for pro-actively monitoring the health and performance of a compressor by detecting precursors to rotating stall and surge using frequency demodulation of acoustic signatures present in the measured signal.

BACKGROUND OF THE INVENTION

The global market for efficient power generation equipment has been expanding at a rapid rate since the mid-1980's. This trend is projected to continue in the future. The Gas Turbine Combined-Cycle power plant, consisting of a Gas-Turbine based topping cycle and a Rankine-based bottoming cycle, continues to be the customer's preferred choice in power generation. This may be due to the relatively-low plant investment cost, and to the continuously-improving operating efficiency of the Gas Turbine based combined cycle, which combine to minimize the cost of electricity production.

In gas turbines used for power generation, a compressor must be allowed to operate at a higher pressure ratio to achieve a higher machine efficiency. During operation of a gas turbine, there may occur a phenomenon known as compressor stall, wherein the pressure ratio of the compressor initially exceeds some critical value at a given speed, resulting in a subsequent reduction of compressor pressure ratio and airflow delivered to the combustor. Compressor stall may result from a variety of reasons, such as when the engine is accelerated too rapidly, or when the inlet profile of air pressure or temperature becomes unduly distorted during normal operation of the engine. Compressor damage due to the ingestion of foreign objects or a malfunction of a portion of the engine control system may also result in a compressor stall and subsequent compressor degradation. If compressor stall remains undetected and permitted to continue, the combustor temperatures and the vibratory stresses induced in the compressor may become sufficiently high to cause damage to the gas turbine.

It is well known that elevated firing temperatures enable increases in combined cycle efficiency and specific power. It is further known that, for a given firing temperature, an optimal cycle pressure ratio is identified which maximizes combined-cycle efficiency. This optimal cycle pressure ratio is theoretically shown to increase with increasing firing temperature. Axial flow compressors, which are at the heart of industrial Gas Turbines, are thus subjected to demands for ever-increasing levels of pressure ratio, with the simultaneous goals of minimal parts count, operational simplicity, and low overall cost. Further, an axial flow compressor is expected to operate at a heightened level of cycle pressure ratio at a compression efficiency that augments the overall cycle efficiency. An axial flow compressor is also expected to perform in an aerodynamically and aero-mechanically stable manner over a wide range in mass flow rate associated with the varying power output characteristics of the combined cycle operation.

The general requirement that led to the present invention was the market need for industrial Gas Turbines of improved combined-cycle efficiency and based on proven technologies for high reliability and availability.

One approach monitors the health of a compressor by measuring the air flow and pressure rise through the compressor. A range of values for the pressure rise is selected a-priori, beyond which the compressor operation is deemed unhealthy and the machine is shut down. Such pressure variations may be attributed to a number of causes such as, for example, unstable combustion, or rotating stall and surge events on the compressor itself. To detect these events, the magnitude and rate of change of pressure rise through the compressor are monitored. When such an event occurs, the magnitude of the pressure rise may drop sharply, and an algorithm monitoring the magnitude and its rate of change may acknowledge the event. This approach, however, does not offer prediction capabilities of rotating stall or surge, and fails to offer information to a real-time control system with sufficient lead time to proactively deal with such events.

BRIEF SUMMARY OF THE INVENTION

The operating compressor pressure ratio of an industrial Gas Turbine engine is typically set at a pre-specified margin away from the surge/stall boundary, generally referred to as surge margin or stall margin, to avoid unstable compressor operation. Uprates on installed base and new products that leverage proven technologies by adhering to existing compressor footprints often require a reduction in the operating surge/stall margin to allow higher pressure ratios. At the heart of these uprates and new products is not only the ability to assess surge/stall margin requirements and corresponding risks of surge, but also the availability of tools to continuously predict and monitor the health of the compressors in field operations. The present invention affords a method of compressor health prediction, monitoring, and controls that may be leveraged to be acted upon for protecting the compressor from being damaged due to stall and/or surge.

Accordingly, the present invention solves the simultaneous need for high cycle pressure ratio commensurate with high efficiency and ample surge margin throughout the operating range of a compressor. More particularly, the present invention is directed to a system and method for pro-actively monitoring and controlling the health of a compressor by identifying stall precursors using frequency demodulation of acoustic signatures. In the exemplary embodiment, at least one sensor is disposed about a compressor casing for measuring at least one compressor parameter, such parameter may include, for example, pressure, velocity, force, vibration, etc. Sensors capable of measuring respective relevant parameters may be employed. For example, pressure sensors may be used to monitor pressure signals, flow sensors may be used to monitor velocity of gases. Upon collecting a pre-specified amount of data, the data are time series analyzed and processed to produce a signal whose amplitude corresponds to the instantaneous frequency of a "locally dominant" component of the input signal, where "locally dominant" is defined with respect to an established reference frequency lying within the spectral region (i.e., frequency range or bandwidth) passed by the band-pass filter (BPF). The frequency demodulated signal (y) is low-pass filtered to remove noise interference and subsequently processed to extract signal characteristics such as, for example, signal amplitude, rate of change, spectral content of the signal, the signal characteristics representing stall precursors.

The stall precursors are then compared with baseline compressor characteristics which are a priori computed as a function of the underlying compressor operating parameters, such as, for example, pressure ratio, air flow, etc., and the difference is used to estimate a degraded compressor operating map. A corresponding compressor operability measure is computed and measured with a design target. If the operability of the compressor is deemed insufficient, protective actions are issued by a real-time control system to mitigate risks to the compressor to maintain the required level of compressor operability.

In another embodiment, the frequency demodulation algorithm, band-pass and low-pass filtering operations may be implemented using analog circuitry to produce an output signal that is sampled and then processed to obtain stall precursors. The stall precursors are subsequently compared with baseline compressor values to determine the health of the compressor and initiate any protective actions deemed necessary.

Some of the corrective actions may include varying the operating line control parameters such as making adjustments to compressor variable vanes, inlet air heat, compressor air bleed, combustor fuel mix, etc., in order to operate the compressor at a near threshold level. Preferably, the corrective actions are initiated prior to the occurrence of a compressor surge event and within a margin identified between an operating line threshold value and the occurrence of a compressor surge event. These corrective steps are iterated until the desired level of compressor operability is achieved.

In one aspect, the present invention provides a method for pro-actively monitoring and controlling a compressor, comprising: (a) monitoring at least one compressor parameter; (b) analyzing the monitored parameter to obtain time-series data; (c) processing the time-series data using a frequency demodulator to produce an output signal, and processing the output signal to determine stall precursors;(d) comparing the stall precursors with predetermined baseline values to identify compressor degradation; (e) performing corrective actions to mitigate compressor degradation to maintain a pre-selected level of compressor operability; and (f) iterating the corrective action performing step until the monitored compressor parameter lies within predetermined threshold. In this method, step (c) further includes i) filtering the time-series analyzed data to reject undesirable signals and produce a filtered output signal; ii) frequency demodulating the filtered signal to produce an output signal with an amplitude corresponding to the instantaneous frequency of a locally dominant component of the input signal; iii) low-pass filtering the frequency demodulated signal to reduce noise interference; and iv) processing the low-pass filtered signal to identify a stall precursor. Corrective actions are preferably initiated by varying operating line parameters and include reducing the loading on the compressor. The operating line parameters are preferably set to a near threshold value. Further, filtering of the time-series data is performed by a band-pass filter, the center frequency ($f_c$) of the band-pass filter is set to the tip passage frequency of compressor blades, this frequency being defined by the product of the number of compressor blades and the rotational rate of the rotor. The step of frequency demodulating the filtered signal may preferably performed by a frequency demodulator, the center, or reference, frequency (fc) of the frequency demodulator being set to the tip passage frequency of compressor blades.

In another aspect, the present invention provides an apparatus for monitoring the health of a compressor, comprising at least one sensor operatively coupled to the compressor for monitoring at least one compressor parameter; a calibration system coupled to the at least one sensor, the calibration system performing time-series analysis (t,x) on the monitored parameter; a processor system for processing and computing stall precursors from the time-series analyzed data; a comparator that compares the stall precursors with predetermined baseline data; and a controller operatively coupled to the comparator, the controller initiating corrective actions to prevent a compressor surge and stall if the stall precursors deviate from the baseline data, the baseline data representing predetermined level of compressor operability. The processor system further comprises: a band-pass filter for producing filtered signals; a first system including a frequency demodulation algorithm for demodulating the filtered signals to produce frequency demodulated signals; and a second system for processing the frequency demodulated signals to extract signal characteristics. The apparatus further comprises a look-up-table (LUT) with memory for storing compressor data including stall precursor data.

In another aspect, the present invention provides a gas turbine of the type having a compressor, a combustor, a method for monitoring the operability of a compressor comprising (a) monitoring at least one compressor parameter; (b) analyzing the monitored parameter to obtain time-series data; (c) processing the time-series data using a frequency demodulator to produce an output signal, and processing the output signal to determine stall precursors; (d) comparing the stall precursors with predetermined baseline values to identify compressor degradation;(e) performing corrective actions to mitigate compressor degradation to maintain a pre-selected level of compressor operability; and (f) iterating the corrective action performing step until the monitored compressor parameter lies within predetermined threshold.

In another aspect, the present invention provides an apparatus for continuously monitoring and controlling the health of a compressor, comprising: means disposed about the compressor for monitoring at least one compressor parameter; means for computing stall measures;

means for comparing the stall measures with predetermined baseline values; and means for initiating corrective actions if the stall measures deviate from said baseline values. The means for computing stall measures includes a frequency demodulator and a processor.

In another aspect, the present invention provides a method for continuously monitoring and controlling the health of a compressor, comprising the steps of: providing a means disposed about the compressor for monitoring at least one compressor parameter; providing a means including a frequency demodulating algorithm for computing stall measures; providing a means for comparing the stall measures with predetermined baseline values; and providing a means for initiating corrective actions if the stall measures deviate from the baseline values.

The benefits of the present invention will become apparent to those skilled in the art from the following detailed description, wherein only the preferred embodiment of the invention is shown and described, simply by way of illustration of the best mode contemplated of carrying out the invention.

DETAILED DESCRIPTION OF THE INVENTION

Figure 1:
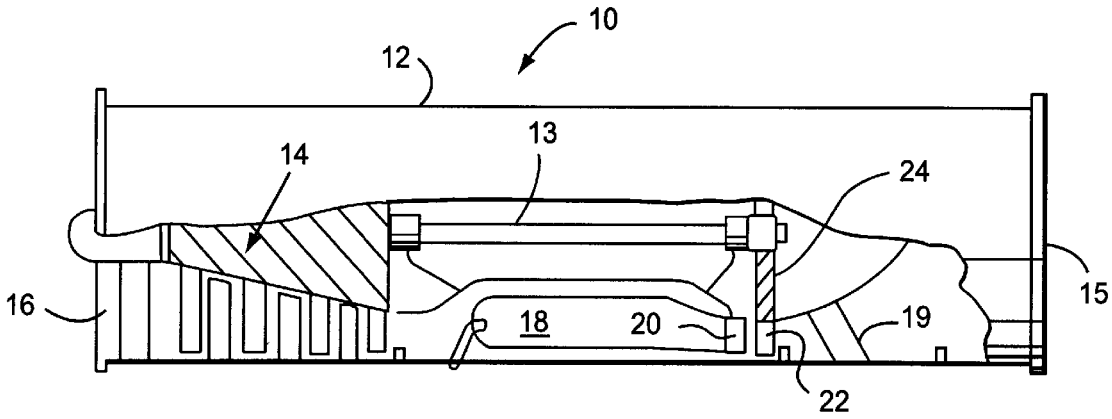
FIG. 1 is a schematic representation of a typical gas turbine engine.

Referring now to FIG. 1, a conventional gas turbine engine is shown at 10 as comprising a cylindrical housing 12 having a compressor 14, which may be of the axial flow type, within the housing adjacent to its forward end. The compressor 14 having an outer casing 26 (FIG. 2) receives air through an annular air inlet 16 and delivers compressed air to a combustion chamber 18.

Within the combustion chamber 18, air is burned with fuel and the resulting combustion gases are directed by a nozzle or guide vane structure 20 to the rotor blades 22 of a turbine rotor 24 for driving the rotor. A shaft 13 drivably connects the turbine rotor 24 with the compressor 14. From the turbine blades 22, the exhaust gases discharge rearwardly through an exhaust duct 19 into the surrounding atmosphere.

Figure 2:
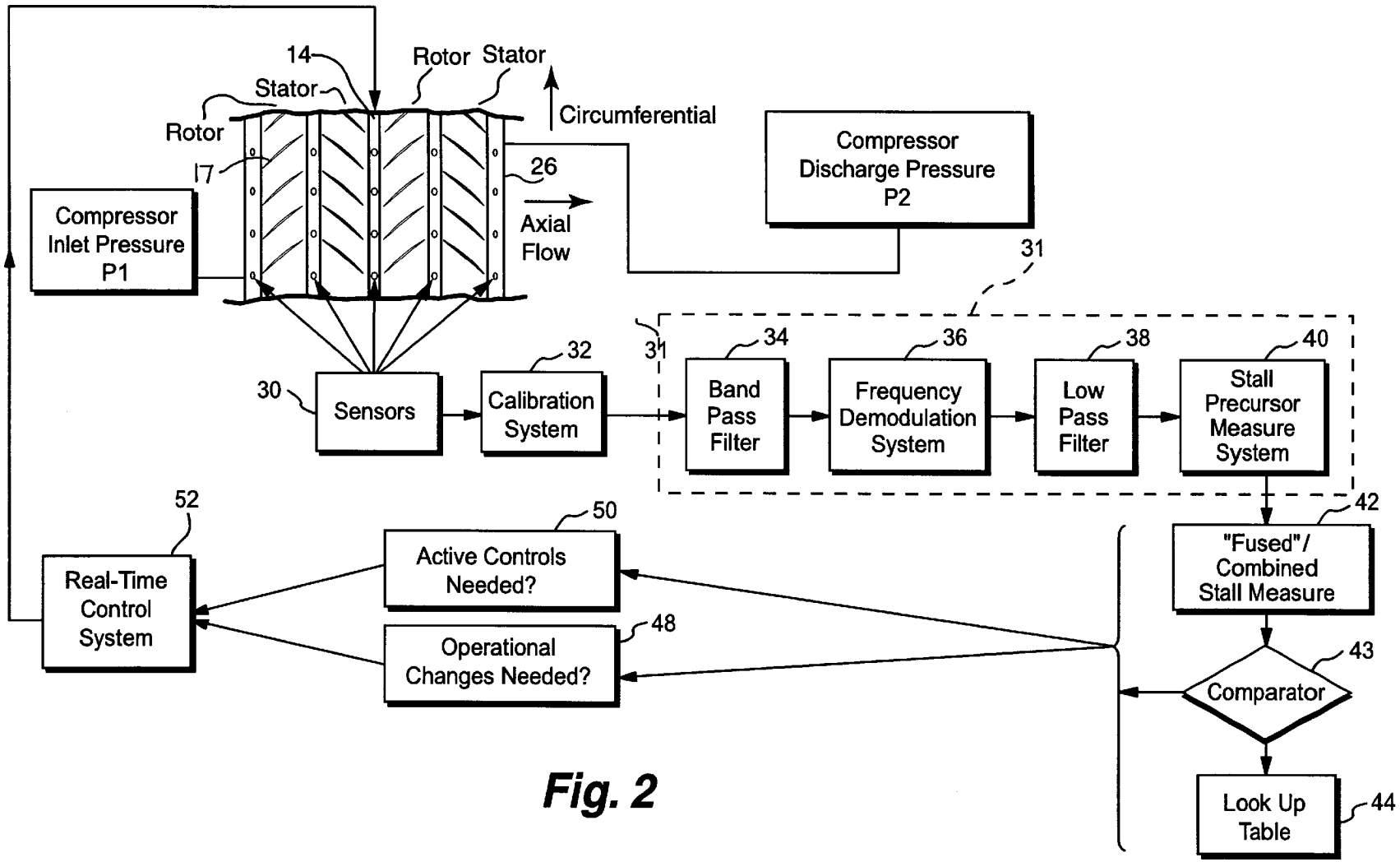
FIG. 2 illustrates a schematic representation of a compressor control operation and detection of precursors to rotating stall and surge using a frequency demodulation algorithm.

Referring now to FIG. 2, there is shown in block diagram fashion an apparatus for monitoring and controlling compressor 14. A single stage of the compressor is illustrated in the present embodiment. In fact, several such stages may be present in a compressor. In the exemplary embodiment as shown in FIG. 2, sensors 30 are disposed about casing 26 for monitoring compressor parameters such as, for example, pressure and velocity of gases flowing through the compressor, force and vibrations exerted on compressor casing 26, to name a few. Dynamic pressure of gases flowing through the compressor is used as an exemplary parameter in the detailed description as set forth below. It will be appreciated that instead of pressure, other compressor parameters may be monitored to infer the health of compressor 14. The dynamic pressure data collected by sensor(s) 30 is fed to a calibration system 32 for processing and storage.

The processing step includes filtering the collected pressure data to remove noise and time-series analyzing the data. The calibration system may include an A/D converter for sampling and digitizing the time-series data. The digitized data is then filtered using a band-pass filter 34 to reject frequencies outside a band of pre-specified width, the pre-specified width being centered on a particular frequency ($f_c$) of interest. The tip passage frequency of the blades 17 of compressor 14 may be used as an example frequency of interest, this frequency being measured by the product of the number of compressor blades and the rotational rate of the rotor 24 (FIG. 1).

When the amount of stored data received from sensors 30 reaches a predetermined level, a frequency demodulator included in system 36 processes the received data from band-pass filter 34 and extracts frequency demodulated signals, i.e., system 36 produces an output signal whose amplitude corresponds, as noted above, to the instantaneous frequency of a locally dominant component in the input signal. Also, the center frequency of the frequency demodulation system 36 is selected, for example, to be the tip passage frequency of rotating blades 17 of compressor 14 (FIG. 1). For example, if the center frequency of the frequency demodulation system 36 is set at a frequency $f_c$, then the output of the frequency demodulation system 36 is zero the instantaneous frequency of the input to this demodulation system is equal to $f_c$. Frequency demodulated signals are smoothed using a low-pass filter 38 to reduce the influence of noise, and the resulting frequency signature is processed by system 40 to extract signal characteristics, such as, for example, amplitude, rate of change of the signal, spectral content, etc., the extracted signal characteristics identified as stall precursor measure which may be stored in system 40. The band-pass filter 34, frequency demodulation system 36, low-pass filter 38 and stall precursor measure system 40, may all be implemented in an integrated unit 31.

Sensor data may also be processed using a plurality of frequency demodulation algorithms operating in parallel, thus increasing the confidence of stall precursor detection. A number of stall precursor magnitudes obtained from respective sensors may be combined in a system 42, and the combined magnitude is compared in a comparator 43 with a combined baseline stall magnitude inferred from a look-up-table 44 to define an upper limit of compressor degradation. The look-up-table 44 may be populated with several sets of baseline compressor values as a function of underlying compressor operating parameters. The level and detailed nature of frequency variation for a baseline compressor is known a priori, as a function of the underlying compressor operating parameters, which provides a basis for inferring the health of compressor 14.

The difference between measured precursor magnitude(s) and the baseline stall measure via existing transfer functions is used to estimate a degraded compressor operating map, and a corresponding compressor operability measure is obtained; i.e., operating stall margin is computed to compare to a design target. The operability of compressor 14 is then deemed sufficient or not. If the compressor operability is deemed insufficient, then a request for providing active controls is initiated as indicated at 50, and a real-time control system 52 provides instructions for actively controlling compressor 14. Control system 52 may also inform an operator via maintenance flags or a visual warning and the like, regarding compressor operability.

However, if it is determined that operational changes are required, appropriate Operating Limit Line required to maintain the design compressor operability level is estimated at 48 and the control system 52 issues actions on a gas turbine to reduce the loading on compressor 14. It will be appreciated that the compressor operability measure estimated at 48 may instead be provided to a decision making system (not shown) to provide appropriate indicators as noted above to an operator.

Active controls by control system 52 may be used to set operating line parameters for the operation of compressor 14. Once the operating line parameters are set, compressor parameters are measured—the measured values representing stall precursors. The measured values are filtered to remove noise and subsequently processed to extract the magnitudes. The extracted magnitudes are compared with predetermined baseline compressor values. If the extracted magnitudes deviate from the predetermined baseline values, then a signal indicative of compressor degradation is issued.

Subsequently, corrective actions are initiated by varying the operating limit line parameters to cause the compressor to function with a desired level of operability. Corrective actions are iterated until the desired level of operability is achieved.

Comparison of monitored compressor parameters to that of baseline compressor values is indicative of the operability of the compressor. The compressor operability data may be used to initiate the desired control system corrective actions to prevent a compressor surge, thus allowing the compressor to operate with a higher efficiency than if additional margin were required to avoid near-stall operation.

Figure 3:
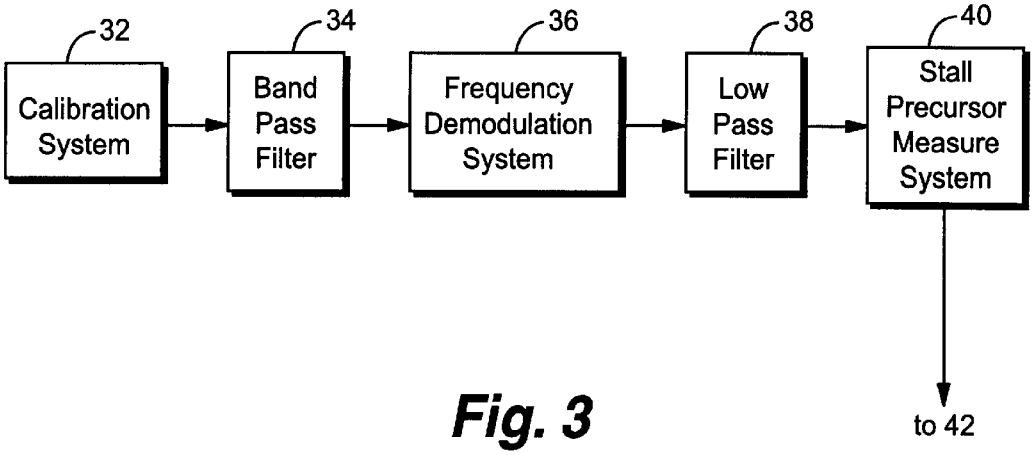
FIG. 3 illustrates a schematic of frequency demodulation scheme for stall precursor detection.
Figure 4:
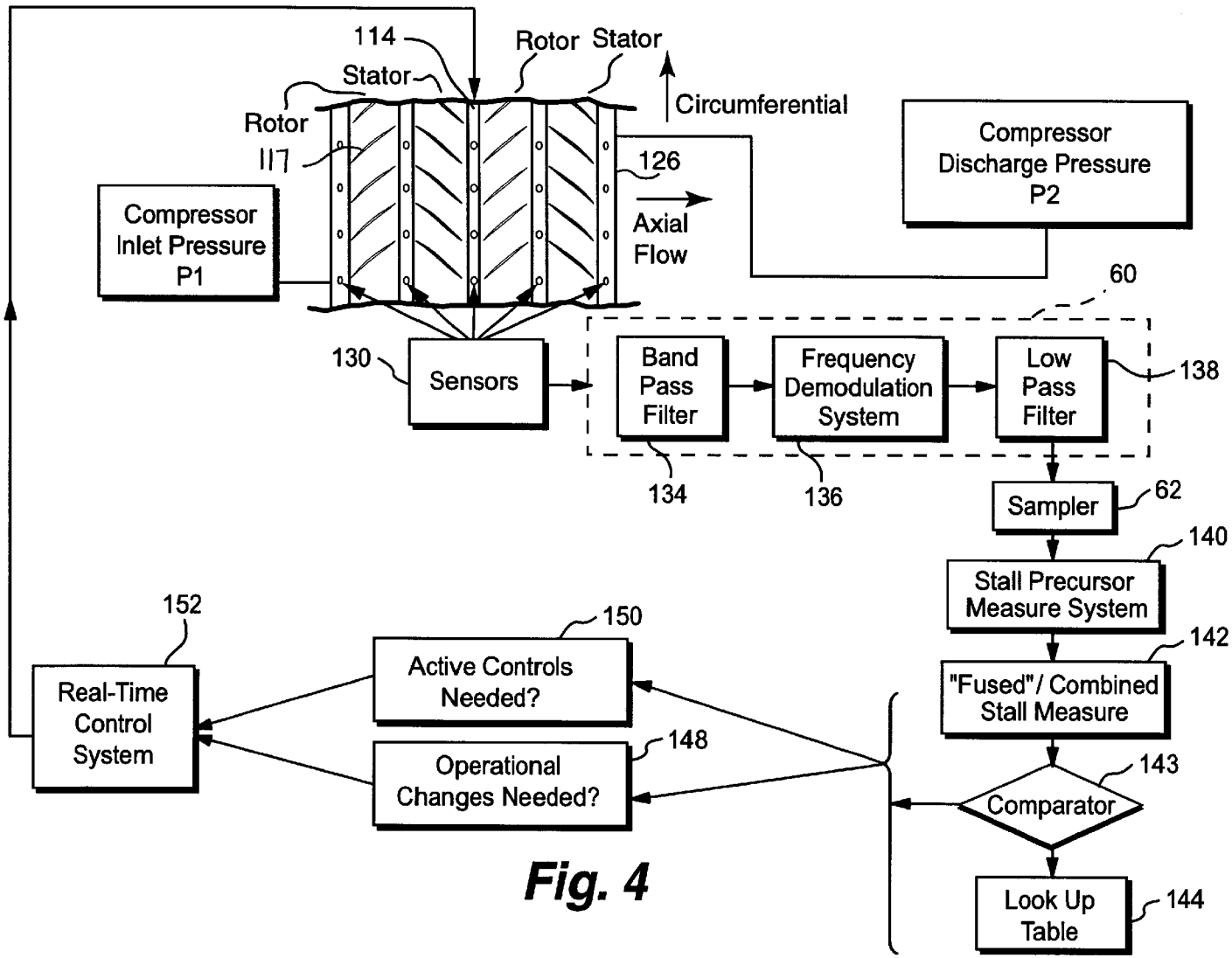
FIG. 4 illustrates another embodiment of the present invention wherein a sensor signal is directly processed by an analog system whose output is then sampled and directed to a processor to compute a stall measure.

FIG. 3 illustrates an exemplary frequency demodulation scheme for the stall precursor detection system of FIG. 2. Referring to FIG. 4, a second embodiment is illustrated where elements in common with the system of FIG. 2 are indicated by similar reference numerals, but with the prefix "1" added. Here, compressor parameters measured by sensors 130 are passed directly to analog system 60 which implements at least one or more of the frequency demodulation, band-pass filtering, and low-pass filtering functions. The analog signals are passed through a sampler 62 and the stall precursor measure system 140 to extract the stall precursor characteristics. The operation of extracting stall precursor characteristics from the frequency demodulated signals output by the analog system 60 and subsequent comparison to baseline compressor values is similar to the operations described as above with respect to FIG. 2. The arrangement of FIG. 4 significantly reduces the sampling rate of the data acquisition process. The sampling rate benefit is realized if both the band-pass filter and frequency demodulator algorithm are realized using analog circuitry.

Figure 5:
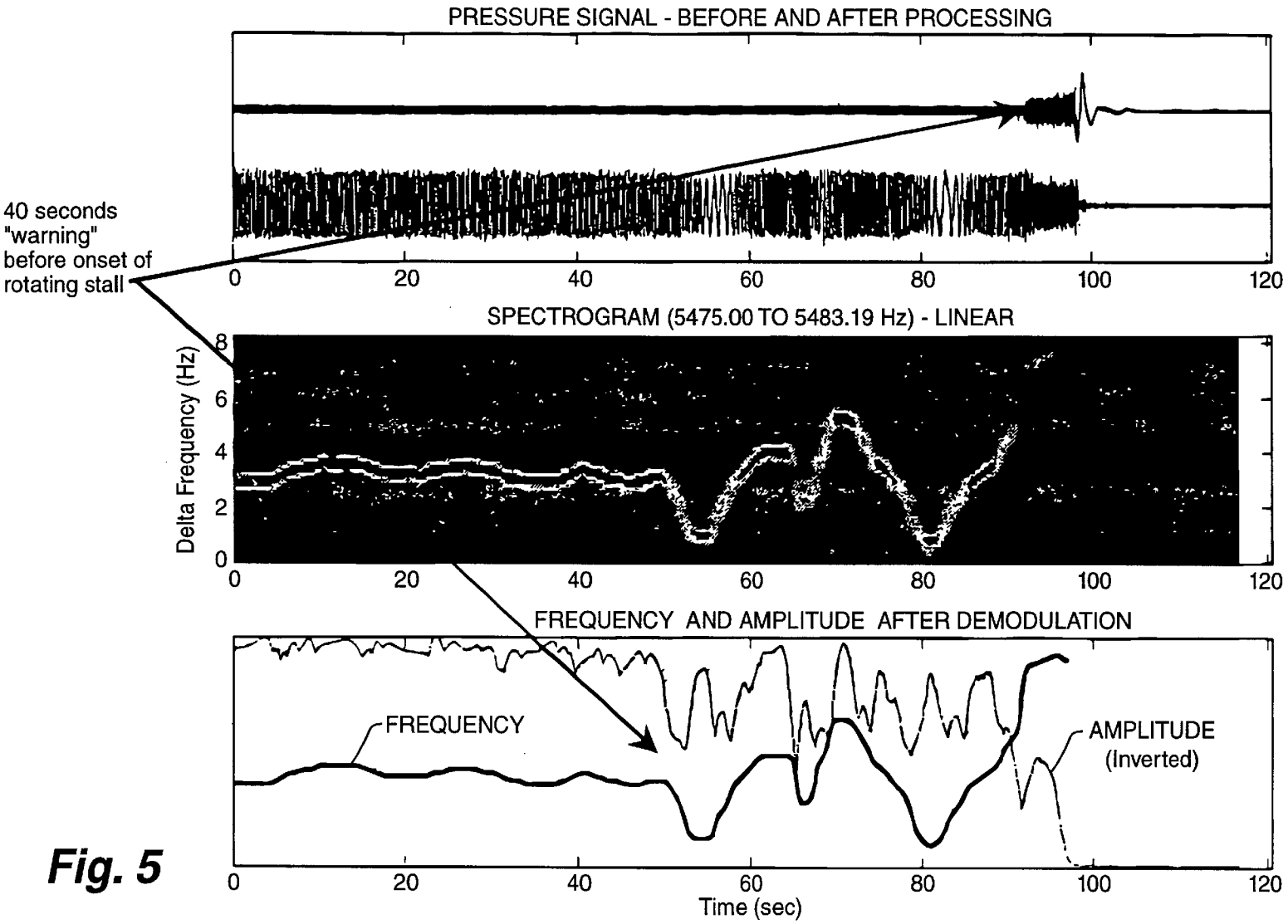
FIG. 5 illustrates an exemplary plot for one set of measurements recorded using the apparatus of FIG. 2.

Referring now to FIG. 5, there is shown an exemplary set of experimental data recorded using the apparatus of FIG. 2, the data depicting the potential effectiveness of the demodulation process on precursor identification.

Figure 6:
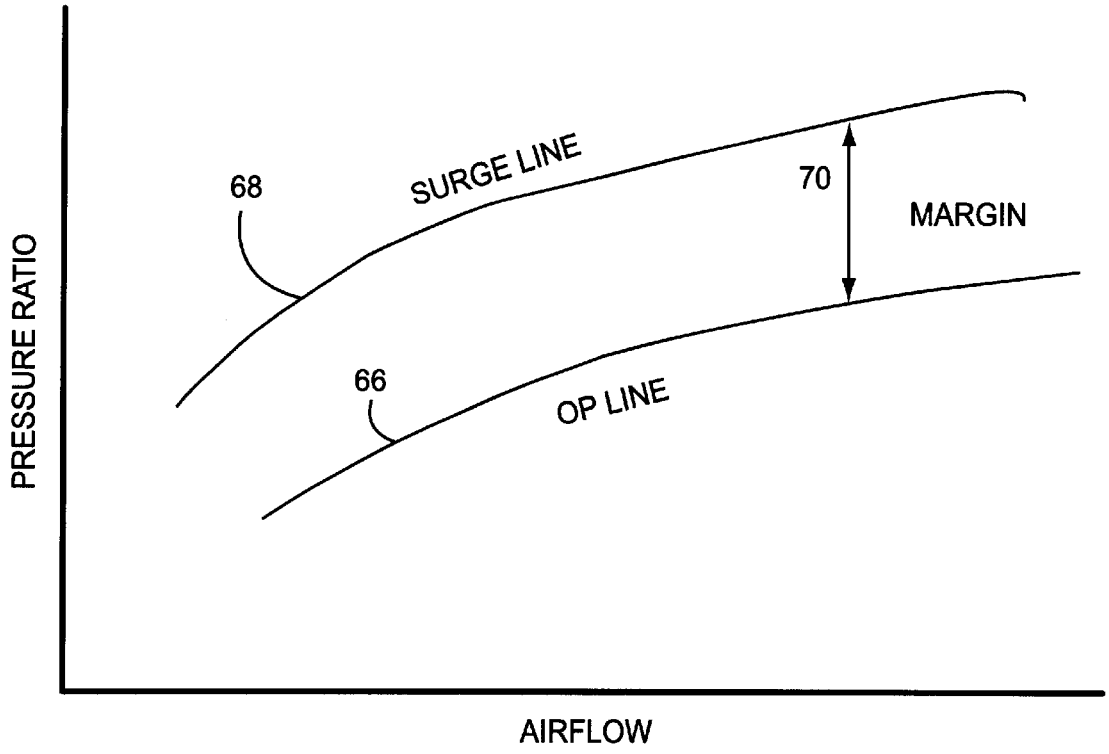
FIG. 6 is a graph illustrating pressure ratio on Y-axis and airflow on X-axis for the compressor stage as shown in FIG. 2.

Referring now to FIG. 6, a graph charting pressure ratio on the Y-axis and airflow on the X-axis is illustrated. As previously discussed, the acceleration of a gas turbine engine may result in a compressor stall or surge wherein the pressure ratio of the compressor may initially exceed some critical value, resulting in a subsequent drastic reduction of compressor pressure ratio and airflow delivered to the combustor. If such a condition is undetected and allowed to continue, the combustor temperatures and vibratory stresses induced in the compressor may become sufficiently high to cause damage to the gas turbine. Thus, the corrective actions initiated in response to detection of an onset or precursor to a compressor stall may prevent the problems identified above from taking place. The OPLINE identified at 66 depicts an operating line that the compressor 14 is operating at. As the airflow is increased into the compressor 14, the compressor may be operated at an increased pressure ratio. Margin 70 indicates that once the gas turbine engine 10 operates at values beyond the values set by the OPLINE as illustrated in the graph, a signal indicative of onset of a compressor stall is issued. Corrective measures by the real-time control system 52 may have to be initiated within margin 70 to avoid a compressor surge and near stall operation of the compressor.

The present invention solves the problem of simultaneous need for high pressure ratios commensurate with high efficiency, and ample surge margin throughout the operating range of the compressor. The present invention further provides a design and an operational strategy that provides optimal pressure ratio and surge margin for cases wherein the Inlet Guide Vanes (IGVs) are tracking along the nominal, full-flow schedule, and wherein the IGVs are closed-down for reduced flow under power-turn-down conditions.

While the invention has been described in connection with what is presently considered to be the most practical and preferred embodiment, it will be understood that the invention is not to be limited to the disclosed embodiment, but on the contrary, is intended to cover various modifications and equivalent arrangements included within the spirit and scope of the appended claims.

What is claimed is:

1. A method for monitoring and controlling a compressor, comprising:

(a) monitoring at least one compressor parameter;

(b) analyzing the monitored parameter to obtain time-series data;

(c) filtering the time-series analyzed data using a band-pass filter centered on a particular frequency of interest;

(d) frequency demodulating the filtered time-series data to produce an output signal, and processing the output signal to determine stall precursors, the frequency demodulation using a reference frequency that is the same as the center frequency of interest;

(e) comparing the stall precursors with predetermined baseline values to identify compressor degradation;

(f) performing corrective actions to mitigate compressor degradation to maintain a preselected level of compressor operability; and (g) iterating said corrective action performing step until the pre-selected level of compressor operability is met, whereby the monitored compressor parameter lies within predetermined threshold.

2. The method of claim 1 wherein step (c) further comprising:

i. filtering the time-series analyzed data to reject undesirable signals and produce a filtered output signal;

ii. frequency demodulating the filtered signal to produce an output signal with an amplitude corresponding to the instantaneous frequency of a locally dominant component of the input signal;

iii. low-pass filtering the frequency demodulated signal to reduce noise interference; and iv. processing the low-pass filtered signal to identify a stall precursor.

3. The method of claim 2, wherein the step of frequency demodulating the filtered signal is performed by a frequency demodulator, and wherein the center frequency is set to a tip passage frequency of the compressor's blades.

4. The method of claim 3 wherein the tip passage frequency is defined by the product of a number of the compressor's blades and the rotational rate of the compressor's rotor.

5. The method of claim 1 wherein said corrective actions are initiated by varying operating line parameters.

6. The method of claim 5 wherein said corrective actions include reducing the loading on the compressor.

7. The method of claim 5 wherein said operating line parameters are set to a near threshold value.

8. The method of claim 1 wherein the at least one compressor parameter is the dynamic pressure of gases flowing through the compressor.

9. The method of claim 1, wherein the at least one compressor parameter is selected from the group comprising pressure, velocity, force and vibration.

10. A method for monitoring and controlling a compressor, comprising the steps of:

(a) monitoring at least one compressor parameters (b) analyzing the monitored parameter to obtain time-series data;

(c) processing the time-series data using a frequency demodulator to produce an output signal, and processing the output signal to determine stall precursors; said processing steps comprising:

i. filtering the time-series analyzed data to reject undesirable signals and produce a filtered output signal;

ii. frequency demodulating the filtered signal to produce an output signal with an amplitude corresponding to the instantaneous frequency of a locally dominant component of the input signal;

iii. low-pass filtering the frequency demodulated signal to reduce noise interference; and iv. processing the low-pass filtered signal to identify a stall precursor;

(d) comparing the stall precursors with predetermined baseline values to identify compressor degradation;

(e) performing corrective actions to mitigate compressor degradation to maintain a preselected level of compressor operability; and (f) iterating said corrective action performing step until the monitored compressor parameter lies within predetermined threshold; and wherein filtering of the time-series data is performed by a band-pass filter, the center frequency ($f_c$) of the band-pass filter is centered on a tip passage frequency of compressor blades, said tip passage frequency is defined by the product of a number of compressor blades and the rotational rate of a rotor.

11. An apparatus for monitoring the health of a compressor, comprising:

at least one sensor operatively coupled to the compressor for monitoring at least one compressor parameter;

a calibration system coupled to said at least one sensor, said calibration system performing time-series analysis (t,x) on the monitored parameter;

a processor system for processing and computing stall precursors from data based on the time-series analyzed parameter, the processor system further comprising:

a band pass filter for producing filtered signals, the band-pass filter centered on a particular frequency of interest;

a first system including a frequency demodulator for demodulating said filtered signals to produce frequency demodulated signals; the frequency demodulator using a reference frequency that is the selected center frequency of interest; and a second system for processing said frequency demodulated signals to extract signal characteristics;

a comparator that compares the stall precursors with predetermined baseline data; and a controller operatively coupled to the comparator, said controller initiating corrective actions to prevent a compressor surge and stall if the stall precursors deviate from the baseline data, said baseline data representing predetermined level of compressor operability.

12. The apparatus of claim 11, further comprises:

a look-up-table (LUT) with memory for storing compressor data including stall precursor data.

13. The apparatus of claim 12 wherein the corrective actions are initiated by varying operating limit line parameters.

14. The apparatus of claim 13 wherein said operating limit line parameters are set to a near threshold value.

15. The apparatus of claim 11, wherein the center frequency is set to a tip passage frequency of the compressor's blades.

16. The apparatus of claim 15, wherein the tip passage frequency is defined by the product of a number of the compressor's blades and the rotational rate of the compressor's rotor.

17. The apparatus of claim 11 wherein the at least one compressor parameter is the dynamic pressure of gases flowing through the compressor.

18. In a gas turbine of the type having a compressor, a method for monitoring the operability of the compressor comprising:

(a) monitoring at least one compressor parameter;

(b) analyzing the monitored parameter to obtain time-series data;

(c) processing the time-series data using a band-pass filter centered on a particular frequency of interest to filter the time-series data and a frequency demodulator using a reference frequency that is the same as the center frequency to produce an output signal by demodulating the filtered time-series data, and processing the output signal to determine stall precursors;

(d) comparing the stall precursors with predetermined baseline values to identify compressor degradation;

(e) performing corrective actions to mitigate compressor degradation to maintain a preselected level of compressor operability; and (f) iterating said corrective action performing step until the monitored compressor parameter lies within predetermined threshold.

19. The method of claim 18 wherein step (c) further comprises:

i. filtering the time-series analyzed data to reject undesirable signals and produce a filtered output signal;

ii. frequency demodulating the filtered signal to produce an output signal with an amplitude corresponding to the instantaneous frequency of a locally dominant component of the input signal;

iii. low-pass filtering the frequency demodulated signal to reduce noise interference; and iv. processing the low-pass filtered signal to identify a stall precursor.

20. The method of claim 18, wherein the center frequency is set to a tip passage frequency of the compressor's blades.

21. The method of claim 18, wherein the band-pass filter has a pre-specified frequency width of 8 Hz.

22. The method of claim 18 wherein the at least one compressor parameter is selected from the group comprising pressure, velocity, force and vibration.

23. An apparatus for monitoring and controlling the health of a compressor, comprising:

means disposed about the compressor for monitoring at least one compressor parameter;

means for computing stall measures, said computing means including means for producing signals filtered to reject frequencies outside a band of frequencies of a pre-specified width, means for frequency demodulating said filtered signals, and means for processing said frequency demodulated signals to extract signal characteristics for computing the stall measures;

means for comparing the stall measures with predetermined baseline values; and means for initiating corrective actions if the stall measures deviate from said baseline values.

24. The apparatus of claim 23, wherein said means for computing stall measures includes a frequency demodulating algorithm.

25. The apparatus of claim 24, wherein the corrective actions are initiated by varying operating limit line parameters.

26. The apparatus of claim 25, wherein said operating limit line parameters are set to a near threshold value.

27. The apparatus of claim 23 wherein the band of frequencies is centered around a frequency that is a tip passage frequency of the compressor's blades.

28. The apparatus of claim 27 wherein the tip passage frequency is defined by the product of a number of compressor blades and the rotational rate of a rotor.

29. The apparatus of claim 23 wherein the pre-specified width is 8 Hz.

30. The apparatus of claim 23 wherein the at least one compressor parameter is selected from the group comprising pressure, velocity, force and vibration.

31. A method for monitoring and controlling the health of a compressor, comprising:

providing a means disposed about the compressor for monitoring at least one compressor parameter;

providing a means having a frequency demodulating algorithm for computing stall measures, said computing means including means for producing signals filtered to reject frequencies outside a band of frequencies of a pre-specified width, means for frequency demodulating said filtered signals, and means for processing said frequency demodulated signals to extract signal characteristics for computing the stall measures;

providing a means for comparing the stall measures with predetermined baseline values; and providing a means for initiating corrective actions if the stall measures deviate from said baseline values.

32. The apparatus of claim 31 wherein the band of frequencies is centered around a frequency that is a tip passage frequency of the compressor's blades.

33. The apparatus of claim 32 wherein the tip passage frequency is defined by the product of a number of compressor blades and the rotational rate of a rotor.

34. The apparatus of claim 31 wherein the pre-specified width is 8 Hz.

35. The apparatus of claim 31 wherein the at least one compressor parameter is selected from the group comprising pressure, velocity, force and vibration.

* * * * *

UNITED STATES PATENT AND TRADEMARK OFFICE

CERTIFICATE OF CORRECTION

PATENT NO. : 6,536,284 B2
DATED : March 25, 2003
INVENTOR(S) : Bonanni, Pierino G.

It is certified that error appears in the above-identified patent and that said Letters Patent is hereby corrected as shown below:

Column 6,
Line 3, after "zero" please insert -- whenever --.

Signed and Sealed this

Twenty-second Day of July, 2003

JAMES E. ROGAN
*Director of the United States Patent and Trademark Office*